US005909974A

United States Patent [19]

Myung

[11] Patent Number: 5,909,974

[45] Date of Patent: Jun. 8, 1999

[54] METHOD FOR PRINTING IN A DRAFT MODE OF A SERIAL PRINTER

[75] Inventor: Ho-Suck Myung, Kyonggi-do, Rep. of Korea

[73] Assignee: SamSung Electronics Co., Ltd., Kyungki-do, Rep. of Korea

[21] Appl. No.: 08/933,850

[22] Filed: Sep. 19, 1997

[30] Foreign Application Priority Data

Sep. 19, 1996 [KR] Rep. of Korea ..... 96-40894

[51] Int. Cl.[6] ..... B41J 19/00

[52] U.S. Cl. ..... 400/283; 400/70; 400/76

[58] Field of Search ..... 400/61, 70, 76, 400/283, 582, 323

[56] References Cited

U.S. PATENT DOCUMENTS 4,586,835 5/1986 Alexander et al. .
4,650,351 3/1987 Engle et al. .
4,728,968 3/1988 Hillmann et al. .
4,969,758 11/1990 Sanders et al. .
5,198,833 3/1993 Kubota .
5,291,824 3/1994 Matsumoto et al. .

*Primary Examiner*—John Hilten
*Attorney, Agent, or Firm*—Robert E. Bushnell, Esq.

[57] ABSTRACT

A method for printing in a draft mode of a serial printer includes a first printing step for printing information data in a first direction on a first line, and a second printing step for printing information data in a second direction opposite to the first direction on a second line. The second printing step includes checking the number of dots corresponding to the data to be printed, and aligning the dots to be printed corresponding to the first and second lines in a predetermined form by determining dots to be printed according to the checked number of dots. According the principles of the present invention, every other dot is skipped and printed in turns, that is, a first dot is printed and a next dot is not printed when the number of the adjacent dots is an odd number. To the contrary, when the number of the adjacent dots is an even number, a first dot is not printed and a next dot is printed. As a result, it is possible to prevent printing data from being refracted by vertically aligning or diagonally aligning the dots.

15 Claims, 3 Drawing Sheets

METHOD FOR PRINTING IN A DRAFT MODE OF A SERIAL PRINTER

CLAIM FOR PRIORITY

This application makes reference to, incorporates the same herein, and claims all benefits accruing under 35 U.S.C. §119 from an application for METHOD FOR PRINTING IN A DRAFT MODE OF A SERIAL PRINTER earlier filed in the Korean Industrial Property Office on Sep. 19, 1996, and there duly assigned Ser. No. 40894/1996, a copy of which application is annexed hereto.

BACKGROUND OF THE INVENTION

1. Technical Field

The present invention relates to a method for printing in a draft mode of a serial printer, and particularly to an improved method for printing in a draft mode of a serial printer which is capable of printing by aligning dots to be printed in a predetermined form according to the number of dots corresponding to data to be printed when bidirectional printing in a draft mode.

2. Related Art

Conventional printer such as a dot matrix printer, inkjet printer and plotter includes a printhead having an array of nozzles mounted on a carriage for printing a plurality of rows of dots in a single scan of a movable print carriage across a printable medium. Typical printer prints information serially one letter per unit time and can be unidirectional or bidirectional. Bidirectional printer can print information on a printable medium in both directions, that is, from left to right of a first row, and then from right to left of a second row next to the first row. As a result, a printing speed of bidirectional printer is two times faster than that of a unidirectional printer which can only print information in one direction and the carriage must be returned to a starting position for each row.

Many contemporary serial printers are provided with a so-called draft mode for rapid printing in which the number of dots or the rejection ink from a nozzle is reduced, for example, to half the number of dots used to make a character pattern under a normal mode. Exemplars of contemporary printers operable both in a draft mode and a normal mode of printing are disclosed in U.S. Pat. No. 4,586,835 for Printer For Printing Characters In Two Alternative Print Qualities issued to Alexander et al., U.S. Pat. No. 4,650,351 for Thermal Printer issued to Engle et al., U.S. Pat. No. 4,728,968 for Arrangement of Discharge Openings In A Printhead Of A Multi-Color Ink Printer issued to Hillman et al., U.S. Pat. No. 4,969,758 for Method Of Improving The Printing Speed Of Impact Dot Printer Printing In A Near Letter Quality Mode issued to Sanders, Jr. et al., and U.S. Pat. No. 5,198,833 for Variable Density Ink-Jet Dot Printer issued to Kubota, and U.S. Pat. No. 5,291,824 for Dot Line Printer Having Ordinary Low Dot And High Dot Density Printing Modes issued to Matsumoto et al. Generally, when the draft mode is selected for high speed printing in those serial printers, printing operation is performed by excluding a certain dot unconditionally. For example, when the dots are adjacent to data to be printed, one dot is printed and a next dot is not printed. Accordingly, when the number of the adjacent dots is an odd number, the vertical lines are aligned. However, when the number of the adjacent dots is an even number, the vertical lines are not properly aligned. As a result, contemporary printers which are operable in a draft mode experience a problem in that data (i.e., font or image) to be printed is refracted when performing bidirectional printing in the draft mode, as the number of dots included in the data to be printed can be both an even number and an odd number.

SUMMARY OF THE INVENTION

Accordingly, it is therefore an object of the present invention to provide an improved serial printer for effectively printing information data in a draft mode.

It is also an object to provide a serial printer and process of printing information data in a draft mode without data refraction.

It is another object to provide a serial printer and process of aligning dots to be printed in a predetermined form according to the number of the dots corresponding to information data to be printed when performing a bidirectional printing operation in a draft mode.

These and other objects of the present invention can be achieved by a method for controlling bidirectional printing of a printhead in a serial printer during a draft mode, which comprises the steps of: determining whether the printhead moves in one of a first direction and a second direction opposite to the first direction for printing data information data on a recording medium during the draft mode; when the printhead moves in the first direction, printing a first dot of the information data and skipping the printing of a next dot of the information data on the recording medium; when the printhead moves in the second direction, determining whether the number of adjacent dots of the information data corresponds to one of an even number and an odd number; when the number of adjacent dots of the information data corresponds to the odd number, printing the first dot of the information data and skipping the printing of the next dot of the information data on the recording medium; and when the number of adjacent dots of said information data corresponds to the even number, printing the next dot of the information data without printing the first dot of the information data on the recording medium.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
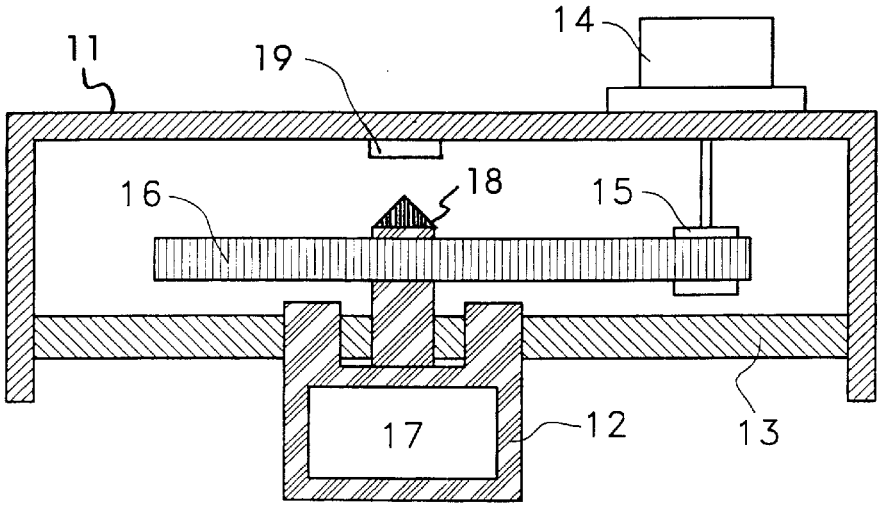
FIG. 1 is a sectional view of a serial printer constructed according to the principles of the present invention.

Referring now to the drawings and particularly to FIG. 1, which illustrates major mechanical components of a printer according to the principles of the present invention. A carrier system of the printer includes a main frame 11, a carriage 12 which supports and moves an optical sensor 18 and printhead, a carrier shaft 13 which acts as a rail for moving the carriage 12, a carrier motor 14 which provides power for moving the carriage 12, a drive pulley 15 which carries the power provided by the carrier motor 14, a timing belt 16 which carries the power of drive pulley 15 into the carriage 12, a head port 17 which contains the printhead in the carriage 12, an optical sensor 18 which is provided at the carriage 12 to transmit an optical signal to the, main frame 11, and a sensing wing 19 which senses the optical signal transmitted from the optical sensor 18.

Figure 2:
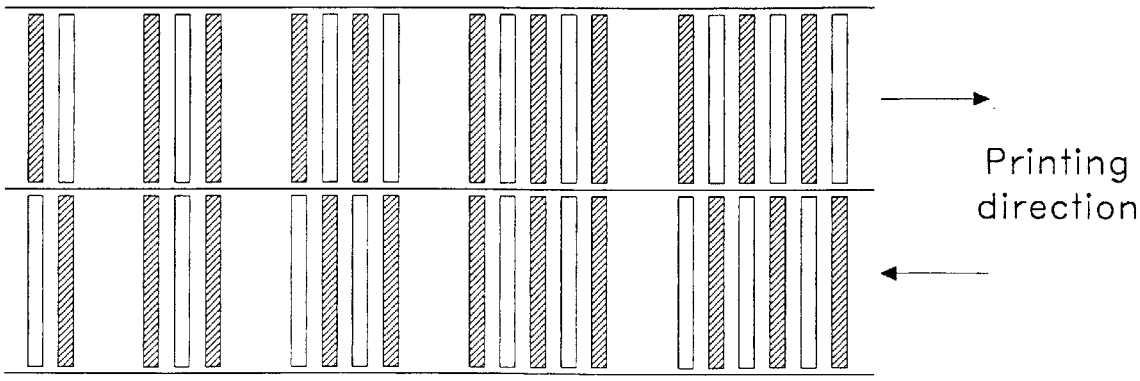
FIG. 2 illustrates print results obtained when the serial printer performs a typical bidirectional printing operation in a draft mode.

When a user selects a draft mode for rapid printing in such a serial printer, printing operation is performed by excluding a certain dot unconditionally in the case that dot corresponding to data to be printed exists. For example, as shown in FIG. 2, in the case that dots are adjacent to data to be printed, one dot is printed and a next dot is not printed. Accordingly, when the number of the adjacent dots is an odd number, the vertical lines are aligned. However, when the number of the adjacent dots is an even number, the vertical lines are not properly aligned. Here, the crossed-hatched in the drawing is a portion where data is printed. On the contrary, white is a portion where data is not printed.

As I have noted previously, many serial printers which are operable in a draft mode experience a problem in that data (i.e., font or image) to be printed is refracted when performing bidirectional printing in the draft mode, as the number of dots included in the data to be printed can be both an even number and an odd number.

Figure 3:
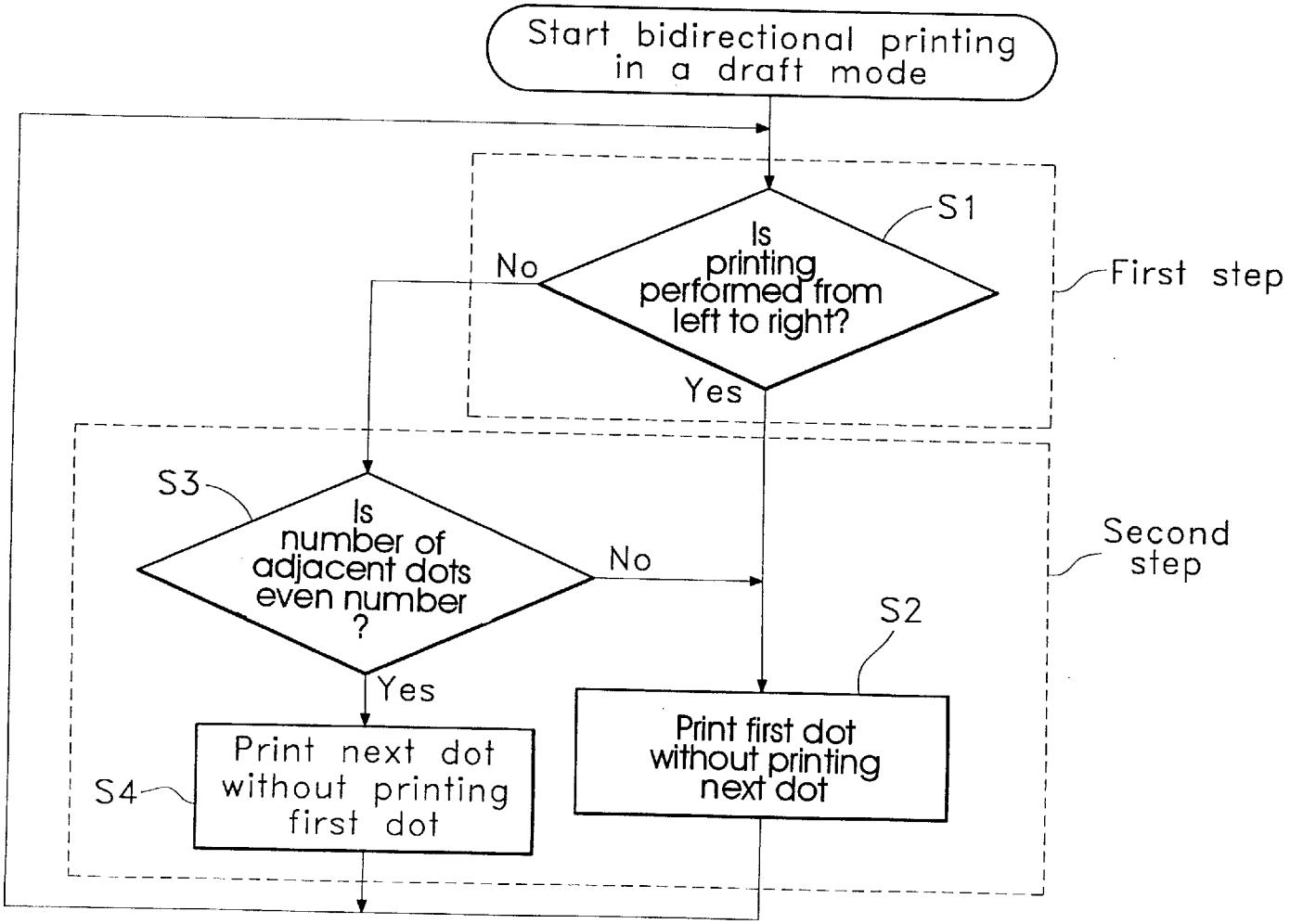
FIG. 3 is a flowchart illustrating a method for aligning vertical lines for the serial printer to perform a bidirectional printing in a draft mode according to the principles of the present invention.
Figure 4:
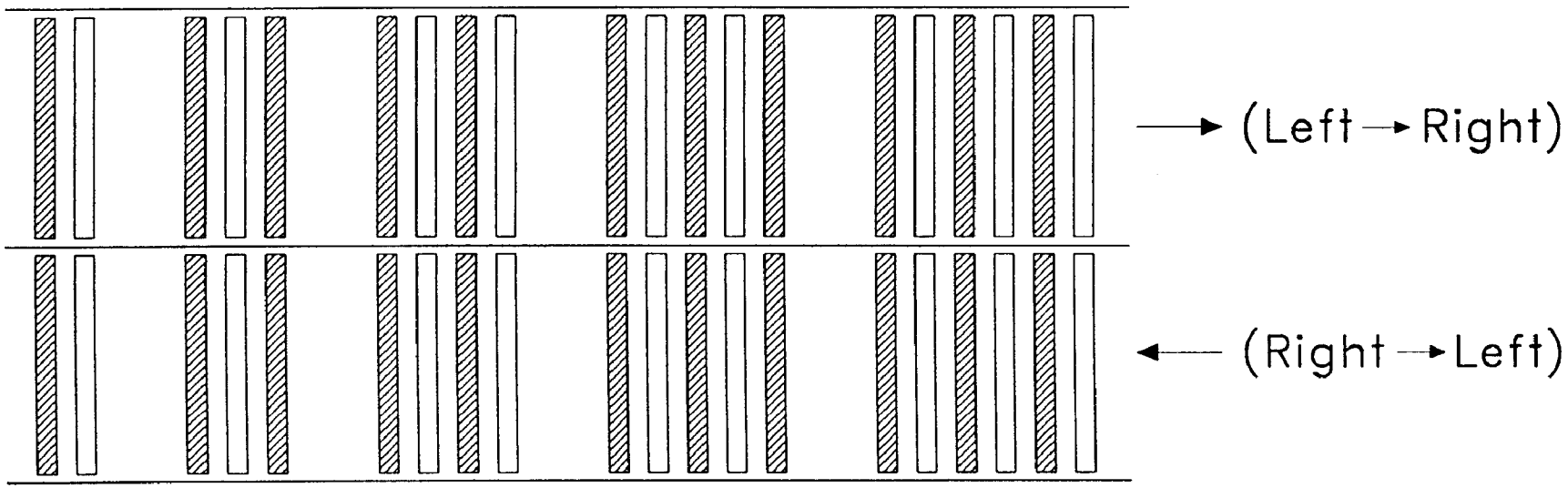
FIG. 4 illustrates print results obtained by aligning vertical lines according to the principles of the present invention.

Turning now to FIG. 3 which is a flowchart illustrating a method for aligning vertical lines for the serial printer to perform a bidirectional printing in a draft mode according to the principles of the present invention, and FIG. 4 which illustrates print results obtained by aligning vertical lines according to the principles of the present invention. As shown in FIG. 3, the method for vertical alignment when printing in a draft mode includes a first step for determining a printing direction of a printer head of the serial printer for printing in a draft mode, and a second step for determining whether the number of dots corresponding to data to be printed according to the printing direction at the first step is a predetermined number and performs the printing operation according to the predetermined number.

Second step includes a step for printing a first dot and not printing a next dot at step S2, when the printing operation is performed in a first direction (for example, from left to right), and a step for printing a next dot without printing a first dot when the number of dots is an even number and printing a first dot and not printing a next dot when the number of dots is an odd number, when the printing operation is performed in a second direction (for example, from right to left), after determining whether the number of adjacent dots corresponding to data to be printed is an even number or an odd number.

On the other hand, to diagonally align the dots to be printed by using the method for printing in a draft mode of a serial printer, when the number of dots is an odd number, a first dot is not printed and a next dot is printed. To the contrary, when the number of dots is an even number, a first dot is printed and a next dot is not printed. As a result, the dots are diagonally aligned.

The order for aligning vertical lines out of methods for printing in a draft mode of the serial printer according to the present invention is illustrated, with reference to FIGS. 3 and 4.

When the bidirectional printing starts in a draft mode of the serial printer, the printing direction is determined first. In the case that the printing direction is a predetermined direction, a dot is first printed and a next dot is not printed as required by steps S1 and S2. At this time, the predetermined printing direction either indicates that the printer head is moved from left to right, or indicates that the printer head is moved from right to left.

On the other hand, when the printing operation is performed in an opposite direction of the predetermined direction, it is determined whether the number of adjacent dots corresponding to data to be printed is an even number or an odd number at step S3. That is, for printing data transmitted from the host computer, the number is determined by adding the number of all dots which is used for printing the data on one line.

As a result of the determination, in the case that the number of the adjacent dots is an odd number at step S3, a first dot is first printed and a next dot is not printed at step S2. In the case that the number of the adjacent dots is an even number at step S3, a first dot is not printed and a next dot is printed at step S4. On the other hand, as another embodiment of the present invention, to diagonally align the dots to be printed, a first dot is not printed and a next dot is printed when the number of dots is an odd number, and the first dot is printed and the next dot is not printed when the number of dots is an even number.

As described above, the present invention contemplates a serial printer capable of printing information data in a draft mode by skipping every other dot and printing dots in turns, a first dot is printed and a next dot is not printed when the number of the adjacent dots is an odd number. In contrast, when the number of the adjacent dots is an even number, a first dot is not printed and a next dot is printed. Accordingly, it is possible to prevent printing data from being refracted by vertically aligning or diagonally aligning the dots.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A method for printing information data in a draft mode of a serial printer, comprising:

a first step of printing information data in a first direction on a first line; and a second step of print information data in a second direction opposite of said first direction on a second line, said second step comprising the steps of:

determining the number of dots corresponding to said information data to be printed; and aligning the dots to be printed corresponding to said first and second lines in a predetermined form after determining the number of dots corresponding to said information data to be printed, with the dots of said information data on said first and second lines that correspond to each other being vertically aligned;

wherein, a first dot of said information data is not printed and a next dot of said information data is printed, when the number of dots corresponds to an even number.

2. A method for printing information data in a draft mode of a serial printer, comprising:

a first step of printing information data in a first direction on a first lines; and a second step of printing information data in a second direction opposite of said first direction on a second line, said second step including:

determining the number of dots corresponding to said information data to be printed;

aligning the dots to be printed corresponding to said first and second lines in a predetermined form after determining the number of dots corresponding to said information data to be printed; and printing a first dot of said information data while skipping a next dot of said information data, when the number of dots corresponds to an odd number.

3. The method of claim 2, wherein, in said aligning step, the dots of said information data on said first and second lines which correspond to each other are aligned diagonally.

4. The method of claim 2, wherein, in said aligning step, the dots of said first and second lines which correspond to each other are aligned vertically.

5. The method of claim 2, wherein, in said second step, said next dot of said information data is printed while skipping printing said first dot of said information data, when the number of dots corresponding to an odd number.

6. A method for controlling bidirectional printing of a printhead in a serial printer during a draft mode, comprising the steps of:

determining whether said printhead moves in one of a first direction and a second direction opposite to said first direction for printing data information data on a recording medium during said draft mode;

when said printhead moves in said first direction, printing a first dot of said information data and skipping the printing of a next dot of said information data on said recording medium;

when said printhead moves in said second direction, determining whether the number of adjacent dots of said information data corresponds to one of an even number and an odd number;

when the number of adjacent dots of said information data corresponds to said odd number, printing said first dot of said information data and skipping the printing of the next dot of said information data on said recording medium; and when the number of adjacent dots of said information data corresponds to said even number, printing the next dot of said information data without printing the first dot of said information data on said recording medium.

7. The method of claim 6, further comprised of said first direction indicating a direction from left to right.

8. The method of claim 7, further comprised of said second direction indicating a direction from right to left.

9. A method for controlling bidirectional printing of a printhead in a serial printer during a draft mode, comprising the steps of:

printing information data on a first line of a recording medium in a first direction during said draft mode; and printing information data on a second line of said recording medium in a second direction opposite to said first direction during said draft mode after:

making a determination of the number of dots of said information data to be printed on said recording medium; and aligning the dots of said information data corresponding to said first and second lines in a predetermined form in response to said determination, with the dots of said information data on said first and second lines that correspond to each other being vertically integrated;

wherein, a first dot of said information data is not printed while a next dot of said information data is printed on said recording medium, when the number of dots corresponds to an even number.

10. A method for controlling bidirectional printing of a printhead in a serial printer during a draft mode, comprising the steps of:

printing information data on a first line of a recording medium in a first direction during said draft mode; and printing information data on a second line of said recording medium in a second direction opposite to said first direction during said draft mode after:

making a determination of the number of dots of said information data to be printed on said recording medium; and aligning the dots of said information data corresponding to said first and second lines in a predetermined form in response to said determination with the dots of said information data on said first and second lines that correspond to each other being vertically aligned;

wherein, a first dot of said information data is printed on said recording medium while a next dot is not printed, when the number of dots corresponds to an odd number.

11. A method for controlling bidirectional printing of a printhead in a serial printer during a draft mode, comprising the steps of:

printing information data on a first line of a recording medium in a first direction during said draft mode; and printing information data on a second line of said recording medium in a second direction opposite to said first direction during said draft mode after:

making a determination of the number of dots of said information data to be printed on said recording medium; and aligning the dots of said information data corresponding to said first and second lines in a predetermined form in response to said determination with the dots of said information data on said first and second lines that correspond to each other being aligned diagonally;

wherein, a first dot of said information data is printed on said recording medium while a next dot is not printed, when the number of dots corresponds to an even number.

12. A method for controlling bidirectional printing of a printhead in a serial printer during a draft mode, comprising the steps of:

printing information data on a first line of a recording medium in a first direction during said draft mode; and printing information data on a second line of said recording medium in a second direction opposite to said first direction during said draft mode after:

making a determination of the number of dots of said information data to be printed on said recording medium; and aligning the dots of said information data corresponding to said first and second lines in a predetermined form in response to said determination with the dots of said information data on said first and second lines that correspond to each other being aligned diagonally;

wherein, a first dot of said information data is not printed while a next dot is printed on said recording medium, when the number of dots corresponds to an odd number.

13. A serial printer for printing data information during a draft mode, comprising:

a rail structure for supporting a guide shaft extending across a width of a recording medium;

a timing belt driven by a main motor, for guiding a carriage assembly along said guide shaft;

said carriage assembly including a printhead mounted thereon, connected to said timing belt for enabling said printhead to move along said guide shaft for printing an image or character on a recording medium; and a controller for controlling bidirectional printing of said printhead on said recording medium during a draft mode by:

determining whether said printhead moves in one of a first direction and a second direction opposite to said first direction for printing data information data on said recording medium during said draft mode;

when said printhead moves in said first direction, controlling said printhead to print a first dot of said information data on a printing line of said recording medium while skipping printing of a next dot of said information data on said printing line;

when said printhead moves in said second direction, determining whether the number of adjacent dots of said information data corresponds to one of an even number and an odd number;

when the number of adjacent dots of said information data corresponds to said odd number, controlling said printhead to print said first dot of said information data on said printing line of said recording medium while skipping printing of the next dot of said information data on said printing line; and when the number of adjacent dots of said information data corresponds to said even number, controlling said printhead to print the next dot of said information data on said printing line of said recording medium while skipping printing the first dot of said information data on said printing line.

14. The serial printer of claim 13, further comprised of said first direction indicating a direction from left to right.

15. The serial printer of claim 7, further comprised of said second direction indicating a direction from right to left.

* * * * *